United States Patent [19]

Gordon

[11] 4,433,838

[45] Feb. 28, 1984

[54] EXERCISE STRUCTURE AND BALL GAME

[76] Inventor: Donald W. Gordon, Yorba Linda, Calif.

[21] Appl. No.: 39,347

[22] Filed: May 16, 1979

[51] Int. Cl.[3] ..... A63B 5/00

[52] U.S. Cl. ..... 272/65; 273/401; 273/411

[58] Field of Search ..... 272/65; 273/401, 411

[56] References Cited

U.S. PATENT DOCUMENTS

| | | | |
|---|---|---|---|
| D. 187,138 | 2/1960 | Highberger | D34/5 |
| 2,324,970 | 7/1943 | Wooley | 272/65 |
| 2,858,132 | 10/1958 | Sidlinger | 272/21 |
| 3,116,809 | 1/1964 | Nissen | 272/65 |
| 3,201,126 | 8/1965 | Nissen | 273/411 |
| 3,256,021 | 6/1966 | Nissen et al. | 273/411 |
| 3,310,305 | 3/1967 | Howe | 272/65 |
| 3,356,366 | 12/1967 | Barthel | 272/65 |
| 3,837,643 | 9/1974 | Lee | 272/65 |
| 4,045,021 | 8/1977 | Nissen | 272/65 |
| 4,119,311 | 10/1978 | Jenkins et al. | 272/65 |

*Primary Examiner*—Peter Chin

*Attorney, Agent, or Firm*—Knobbe, Martens, Olson & Bear

[57] ABSTRACT

A structure for use as an exercise compartment and a method for playing a ball game therein is disclosed. The structure has a horizontal rebound surface which is supported above the ground and has means for enclosing the air space above said surface to form a cell, said cell being of a size suitable for enclosing at least one human using said surface as a springboard for exercise or for playing the ball game.

11 Claims, 11 Drawing Figures

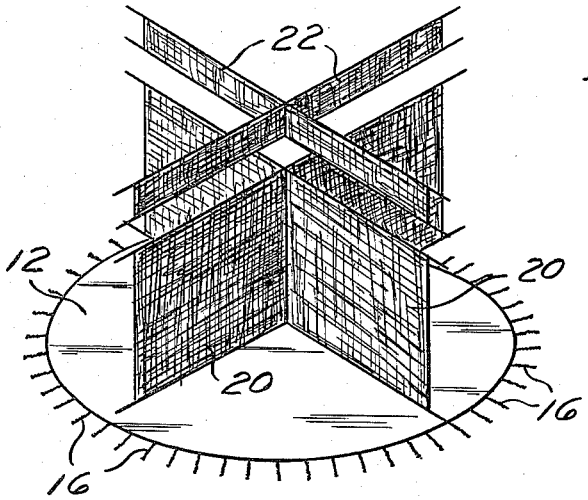
Fig. 6
Fig. 7
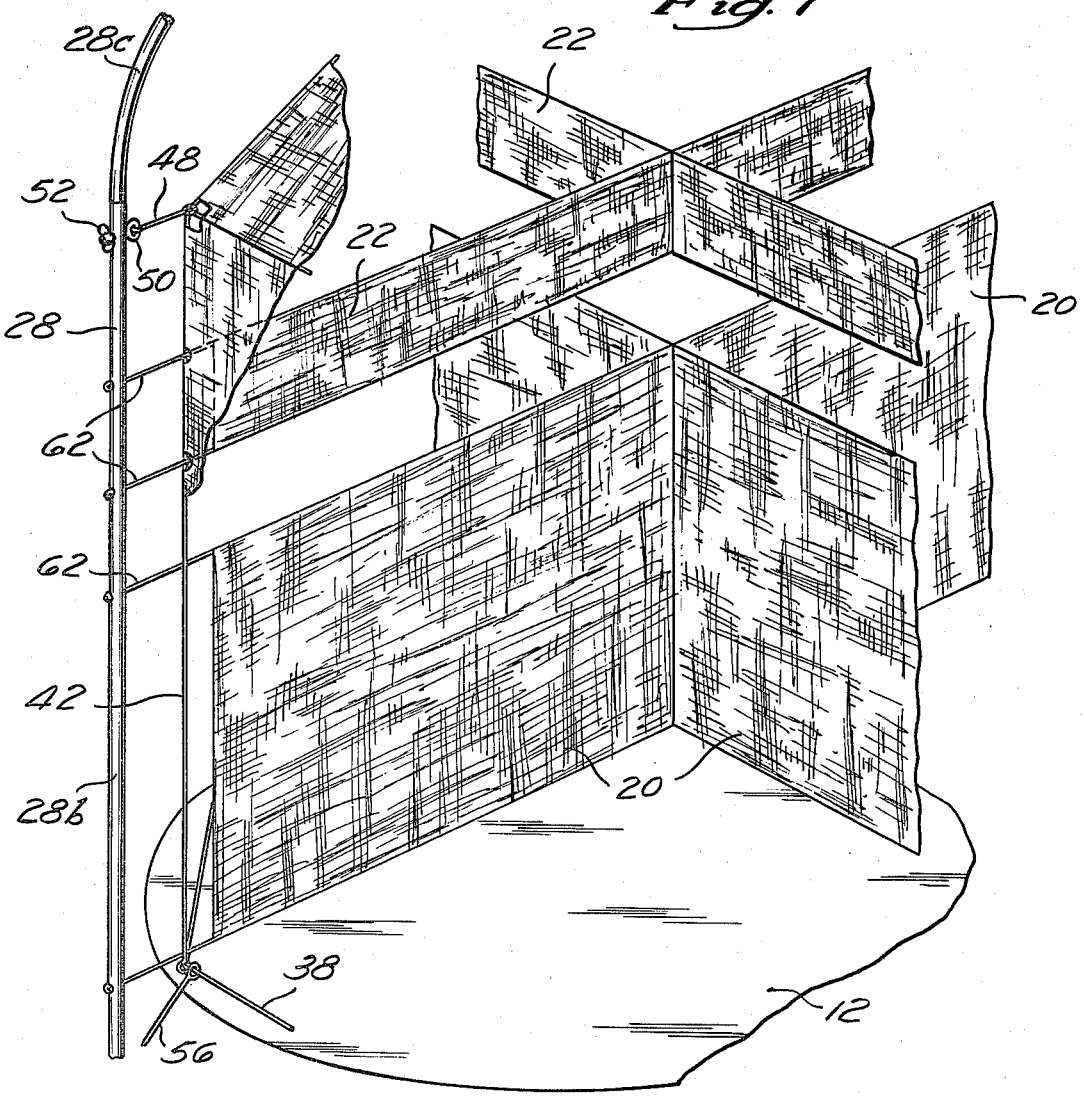

Fig. 9
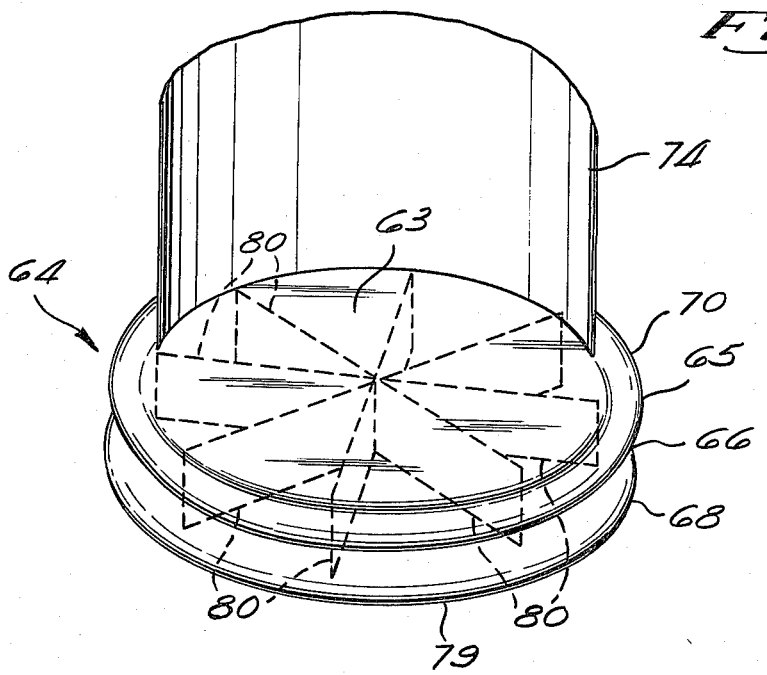
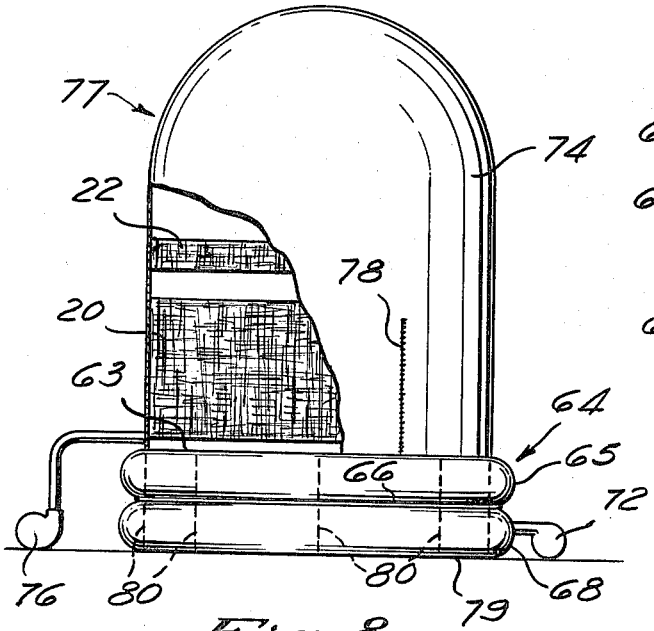
Fig. 8
Fig. 10
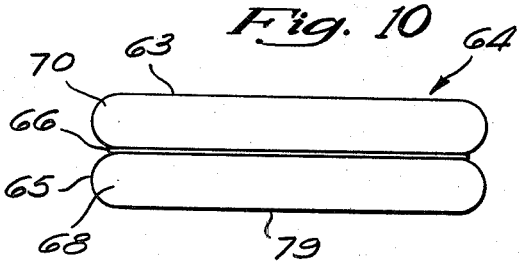
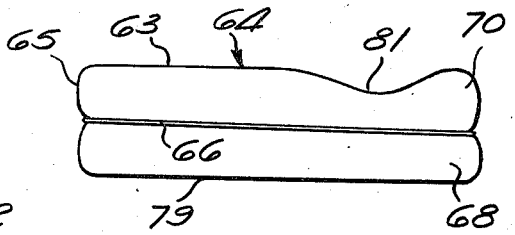
Fig. 11

EXERCISE STRUCTURE AND BALL GAME

BACKGROUND OF THE INVENTION

The field of the invention is directed to exercise devices and games associated therewith.

The trampoline is well known as an exercise device. Traditionally, a trampoline is formed from a sheet of material such as canvas which forms the trampoline bed and which is attached to a rigid support frame by elongate elastic means such as springs. The sheet of material is therefore resiliently supported above the ground in a horizontal position, and functions as a springboard for the user. In using the trampoline, one jumps up and down on the bed and, with practice, can perform acrobatic feats in mid-air above the bed.

An important parameter of trampolines which allows one to perform such gymnastics will be designated "rebound factor" for the purposes of this specification. Rebound factor as herein defined is a percentage of the distance an object will be rebound after falling onto the bed from said distance. Rebound factor therefore is a function of the weight of the object as well as the spring of the bed. Typically, a trampoline will have a rebound factor of about 50% for an average human being. Thus, if an average adult were to fall 10 feet onto a trampoline, he would be rebounded about five feet into the air.

Although the trampoline offers great enjoyment and exercise for the user, it also poses significant dangers.

Many injuries have resulted in using a trampoline from the user falling from the bed onto the ground below or falling onto hard objects such as the support frame or springs. Also, due to the construction of the trampoline, it is quite easy for the user's arm or leg to slip between the support frame and the bed which can cause severe injury.

Games have been created for play on a trampoline. One of these games involves a volleyball-type net which is suspended above the trampoline bed. The game is then played in a volleyball-type fashion, upon the trampoline with two or more players hitting or throwing the ball above the net. A variation of this game as generally described in U.S. Pat. Nos. 3,201,126, 3,256,021, and 3,312,471, is to have the net extend down to the bed and to have a hole in the net, with the object being to throw the ball through the hole in the net rather than above the net.

These games, although offering fun and exercise, possess all of the serious injury potential of the trampoline alone. In fact, the dangers are probably greater in that the players can easily become more concerned with the competitiveness of the game rather than their proximity to the edge of the trampoline bed.

Also known in the art is a device which consists of an inflated pneumatic cushion, the upper side of which is enclosed by an inflated structure which serves as the walls and roof. The device is particularly designed for children who enjoy walking about the soft cushion. This device offers an advantage over trampoline games in that there are no rigid supports which can cause injury. However, it suffers the disadvantage in that the rebound factor of the cushion is much less than that of a trampoline bed being only about 10% for an average adult.

The disclosed invention is a significant improvement over past devices in that it offers the safety of the pneumatic cushion devices while offering the rebound factor of the trampoline.

SUMMARY OF THE INVENTION

The disclosed invention is a structure in which one or more persons can exercise. The invention also includes a method for playing a ball game within the exercise structure. The structure includes a rebound surface, such as a trampoline bed, which acts as a springboard for the user and is supported above the ground. The rebound surface has a rebound factor of at least 20%, preferably at least 30% and optimally at least 50%. The air space above the surface is enclosed to form a cell of a sufficient size to permit at least one person to exercise within the cell.

The bouncing form of exercise, as on a trampoline, is well known as one of the most beneficial of exercises known. This is due to the fact that, in jumping up and down on the resilient rebound surface, gravitational forces are exerted upon the body of the user, putting resistance on virtually every cell of the body. Therefore, this exercise affects virtually every cell and each cell resists the pull of the gravitational or "G" forces similar to large muscle groups resisting weights. The pulse rate is increased as rapidly as when running, and the lungs and cardiovascular system are developed. In addition, the exercise is excellent for reducing and strengthening the stomach and waist as well as developing whole body coordination and timing and developing aerial balance and equilibrium. This form of exercise affects all portions of the body equally and does not put excessive stress upon the joints. Thus, there is no tendency to produce inflamation within the joints or bursitis such as commonly incurred in a sport such as tennis, and which is referred to as "tennis elbow".

This highly beneficial exercise can be obtained without the dangers normally encountered in the standard trampoline. This is due to the special construction of the disclosed inventive structure. Specifically, the structure has means for enclosing the air space above the rebound surface which forms a cell within which the user can exercise. The cell is of the size suitable to enclose at least one person and preferably at least four persons. The enclosing means is attached at or within the outer perimeter of the rebound surface or bed, thus making it virtually impossible for the user to fall off of the surface or encounter any foreign hard obstacles which could cause injury. In short, one can enjoy all of the benefits of the exercise with a minimal risk of any injury.

The device also allows multiple users to exercise within the structure at the same time without fear of injury. Two strong perpendicular restraining nets which divide the cell into quadrants allow as many as four persons to use the surface at a time. A person in such a quadrant may safely exercise due to these restraining nets which prevent the users from injuring each other by entering another's quadrant. Additional restraining nets could be added, to accommodate greater than four players if desired.

Another aspect of the invention involves a ball game which is played within the exercise structure. The perpendicular restraining nets are again stretched across the cell dividing the cell into four quadrants. Each player has his own quadrant. Two perpendicular game nets are also stretched across the cell above the restraining nets and in generally the same planes. A bouncing volleyball-like game is then played in which a ball is hit or thrown above the game net. The game incorporates the essential elements of volleyball, rebounding in basketball, racquetball, tennis, Ping-Pong and water polo.

Since the rebound surface has a large rebound factor, the disclosed invention offers all of the exercise, excitement, and enjoyment of a trampoline. However, due to the fact that the air space of the rebound surface is enclosed within a protective cell thereby avoiding the danger of a person falling off the surface or hitting a rigid support member, and the fact that restraining nets prevent multiple players from injuring one another, the disclosed invention virtually eliminates the disadvantages of prior trampoline activities. A further advantage of the structure is its ease in manufacture which allows the structure to be constructed at a much lower cost than that required for installing racquetball or tennis courts.

DESCRIPTION OF THE DRAWINGS

These and other features of the present invention are best understood through the following detailed description of the preferred embodiments which reference the drawings, in which:

FIG. 6 is a cutaway view of the restraining and game nets, rebound surface, and springs inside the exercise structure of FIG. 1;

FIG. 7 is an enlarged cutaway view of the restraining and game nets of FIG. 6 within the exercise structure, and also shows their means of attachment to the supporting frame of FIG. 2;

FIG. 8 is a perspective view, partially in section, of an alternative embodiment of the invention;

FIG. 9 is an enlarged view of the lower portion of the alternative embodiment shown in FIG. 8, with the upper cell structure partially cut away;

FIG. 10 is a schematic illustration of the rebound surface at equilibrium of the alternative embodiment of FIGS. 8 and 9; and FIG. 11 is a schematic illustration showing the effect of depressing the rebound surface of the alternative embodiment of FIGS. 8 and 9.

DETAILED DESCRIPTION OF THE PREFERRED EMBODIMENTS

Figure 1:
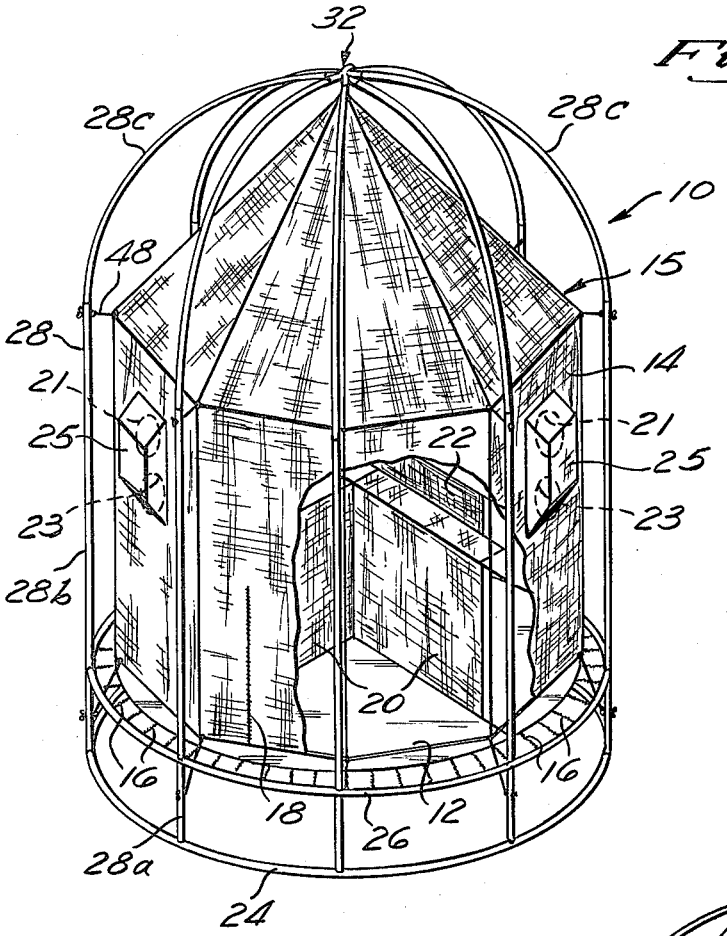
FIG. 1 is a perspective view, partially cut away, of the entire exercise structure.

Referring first to FIG. 1, the preferred embodiment of the invention is shown to comprise a structural metal frame system 10 which supports a flexible rebound surface 12 which, in the preferred embodiment, is round and 13 feet, 6 inches in diameter. The rebound surface has a rebound factor of at least 20%, preferably at least 30% and optimally at least 50%. The air space above the rebound surface 12 and within the metal framework 10 is enclosed by a fabric skirt 14 which forms the exercise cell generally shown as 15. The fabric used to form skirt 14 is preferably breather material, that is, an open-weave netting through which air easily passes. The rebound surface 12 is attached to the framework 10 by means of a plurality of springs 16 in the manner commonly used in constructing trampolines. One can enter the interior of the cell 15 through an opening such as that created by a zipper 18. Within the cell 15 are shown two mutually perpendicular restraining nets 20 and above them, two smaller mutually perpendicular game nets 22. As part of a ball game described later, a first aperture 21 and second aperture 23 are shown through the fabric of cell 15. A fabric ramp 25 is attached to the exterior of cell 15 over the apertures 21 and 23.

Figure 2:
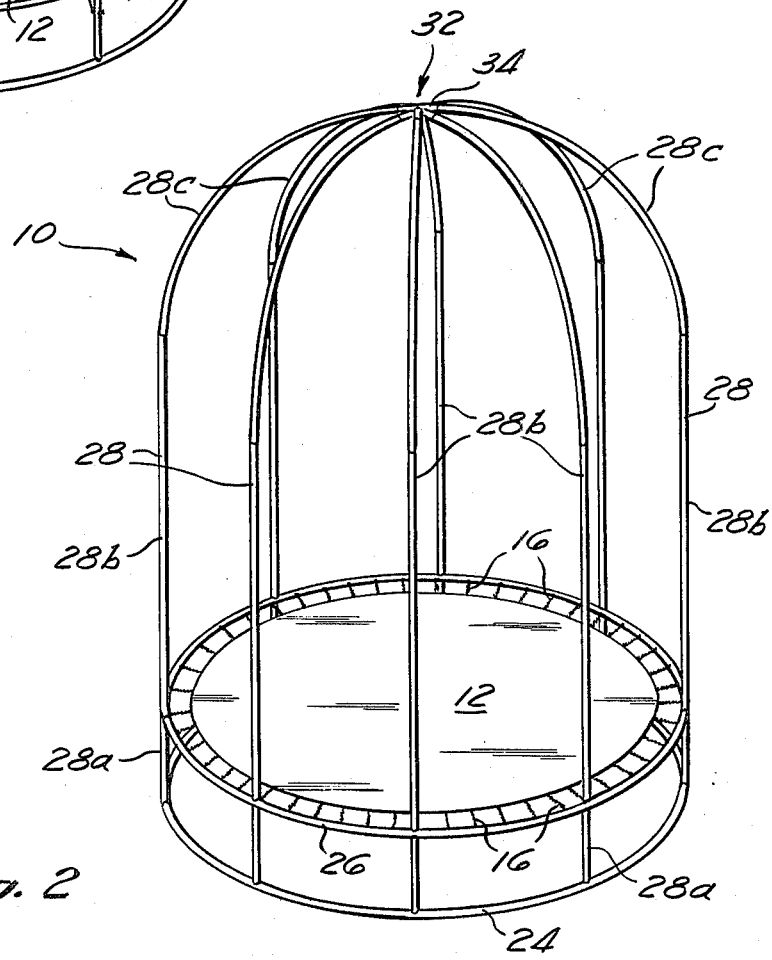
FIG. 2 is a perspective view of the supporting frame and rebound surface of the exercise structure of FIG. 1, with the fabric (from other than the rebound surface) and cable sections removed.

Referring now to FIG. 2, the frame structure 10 generally comprises a lower, rigid circular support frame 24, an upper, rigid circular support frame 26, and eight vertical support members 28 which connect the upper and lower support frames 24,26, and which extend above the upper support frame 26, curving to meet at an apex shown generally as 32. In the preferred embodiment, the lower support frame 24 is generally circular in shape and lays horizontally on the ground. A preferred diameter of the lower support frame is approximately 14 feet. The upper support frame 26 is above and generally parallel to the lower support frame 24, is generally in the plane of the rebound surface 12, and directly supports said surface 12 above the ground. It also is preferably circular and approximately 14 feet in diameter.

There are preferably eight separate vertical support members 28 arranged at regular (45°) intervals ahout said upper and lower support frames 24,26, and which rise vertically to meet at the apex 32.

The upper support frame 26 is approximately three feet above the lower support frame 24 and the structure 10 itself measures about 20 feet from the ground to apex 32.

Figure 3:
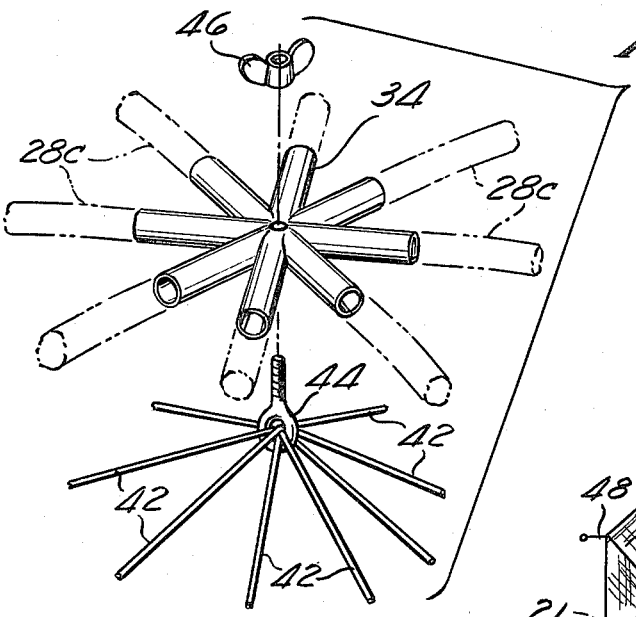
FIG. 3 is an enlarged and exploded view of the device used to connect the apex of the said exercise structure.

The support structure 10 is made from sections of lightweight metal piping such as aluminum or aluminum alloy. The sections of the piping are joined together through male-female joints (not shown). Thus, the lower and upper support frames 24 and 26 are composed of four sections of piping of generally equal arc length (90°). Each includes an extending, axially centered pin at one end, and an axially centered bore or pocket at the other end sized to tightly receive the pin of the next adjacent section. The vertical support member 28 is composed of three sections of piping. The first section 28*a* connects the lower and upper support frames 24,26, the second section 28*b* rises vertically to the point of curvature of the vertical support member 28, and the third section 28*c* of piping is curved so as to allow the vertical support members 28 to meet at the apex 32. The eight vertical support members 28 meet at the apex through a spider joint 34 which is best shown in an enlarged view in FIG. 3. This joint 34 is engaged with the third section 28*c* using a male-female joint as previously described. The section 28*c* is advantageously identical to the 90° sections of the support frames 24 and 26 to reduce manufacturing costs.

Figure 4:
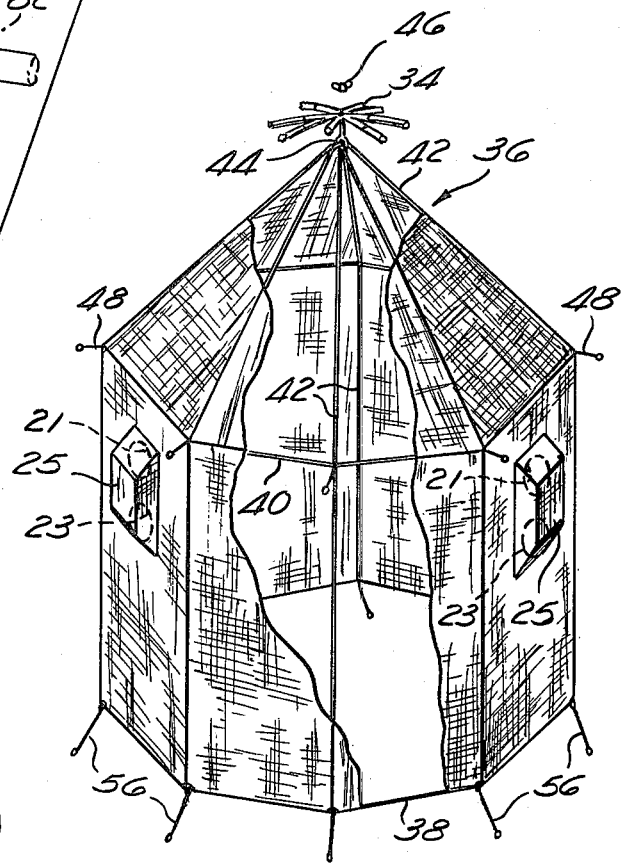
FIG. 4 is a perspective view of the cable structure of the cell of FIG. 1, with the supporting frame of FIG. 2, springs and rebound surface removed.

Reference is now made to FIG. 4, in which the cable system is shown generally as 36. The skirt 14 is located between the cable system 36 and the framework structure 10. The cable system 36 thereby functions to affix the skirting 14 to the framework structure 10, as will be discussed in detail below with respect to FIG. 5. The cable system 36 comprises a lower octagonal cable 38, an upper octagonal cable 40, and eight vertical cables 42 which meet at an eye bolt 44. The components of the apex 32 including the eye bolt 44 are shown more clearly in FIG. 3, in which the vertical cables 42 are shown connected through the opening in the eye bolt 44. In this exploded view, the shank of the eye bolt is shown as passing through the center of the spider joint 34. The eye bolt 44 is then tightened through the use of a wing nut 46, as is apparent to those of ordinary skill in the art.

The cable in the cable system 36 can be made from a strong rope or a metal cord covered with a plastic material, as is well known to those of ordinary skill in the art.

The lower and upper octagons formed by octagonal cables 38,40 have cross-sectional maximum widths of approximately 13 feet, 6 inches, that is, slightly less than or equal to the diameter of the rebound surface 12. The distance between the upper and lower octagonal cables 38,40 is approximately 11 feet, 3 inches, and the distance from the upper octagonal cable 40 to the eye bolt 44 is approximately 5 feet, 6 inches.

Figure 5:
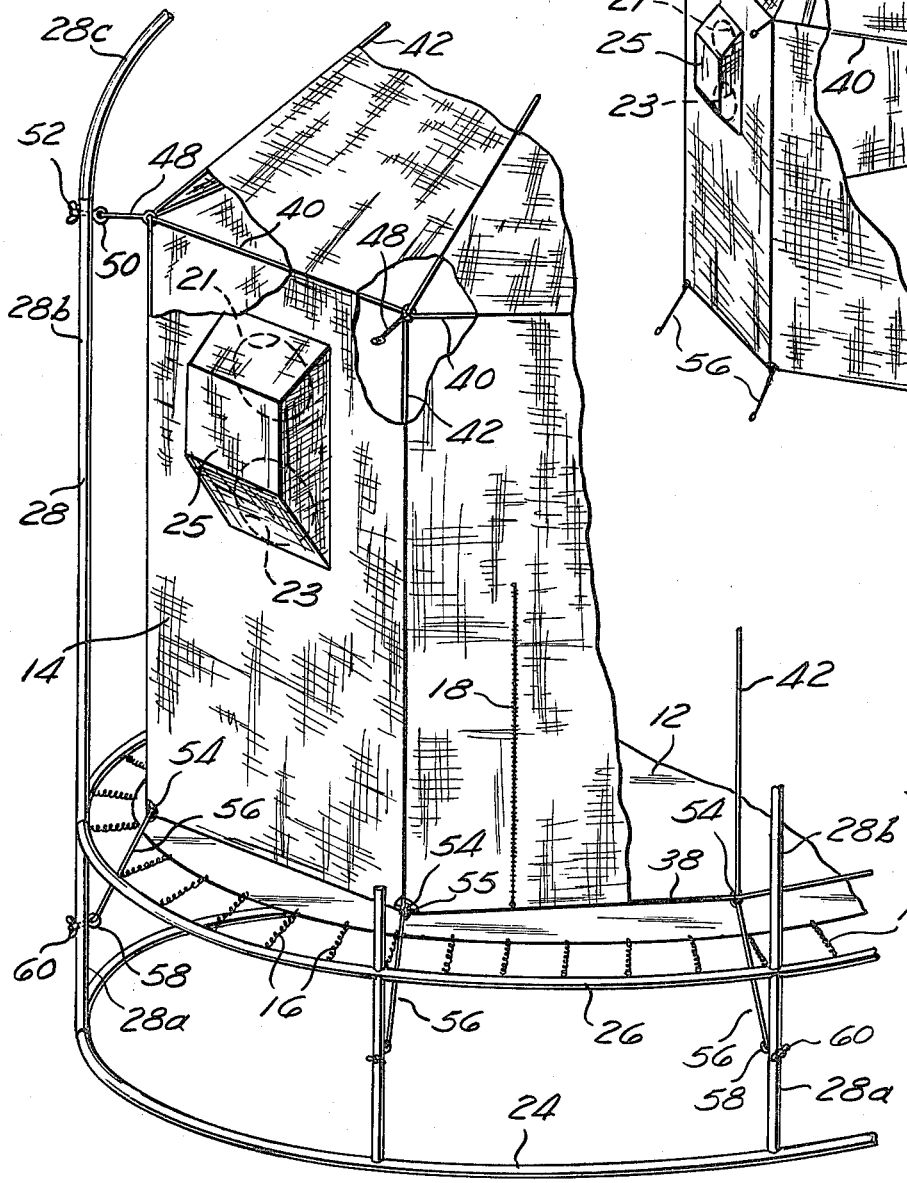
FIG. 5 is a partial perspective view of the lower portion of the exercise structure partially cut away to show the details of fabric, frame, and cable interconnections.

Referring now to FIG. 5, the remainder of the anchoring of the cable system 36 and skirt 14 to the framework 10 will be described. The upper octagonal cable 40 is attached to each of the vertical support members 28 by a fastening cable 48, which in turn is attached to an eye bolt 50 that is threaded through a hole in the vertical support member 28 and is tightened with the use of a wing nut 52. A hem (not shown) is formed at the bottom edge of the skirt 14, and the lower octagonal cable 38 is threaded through this hem. Each of the eight vertical cables 42 is tied to the lower octagonal cable 38 at this hem, and located at the outer perimeter of the rebound surface 12, generally shown at point 54. At points 55, in close proximity to each of the points 54, the lower octagonal cable 38 is attached to anchoring cables 56 which are in turn attached to a portion of the vertical support member 28 approximately half-way along section 28*a*. The anchoring cables 56 are connected to the vertical support section 28*a* through the use of an eye bolt 58 and wing nut 60 as is well known to those of ordinary skill in the art. Because of the diagonal direction of cables 56, they pull the octagonal cable 38 and vertical cables 42 downward and outward, forming a relatively unyielding cable system 36 for forming the cell 15. In addition, the tightening of the cable system 36 with wing nuts, as described, holds the framework 10, with its male-female joints, together.

The result of this fastening arrangement is that the skirt 14 is accurately positioned adjacent the perimeter of the rebounding surface 12, without actually being fastened to the outer perimeter of the rebound surface 12. Therefore, the skirt 14 at the interface of the rebound surface 12 takes on a generally octagonal shape in conformance to the lower octagonal cable 38. Advantageously, the skirt 14 is as close to the outer perimeter of the rebound surface 12 as possible. The exercise cell 15 is formed completely at or within the rebound surface 12, and therefore a person within the exercise cell 15 of the invention cannot fall from the rebound surface 12 or encounter hard obstacles such as the springs 16 or the support frame 10. In addition, it is not possible for one inside the exercise structure to accidentally have an arm or leg slip through the space between the upper support frame 26 and the rebound surface 12. Because the vertical skirt 14 is held taut by the cable system 36, a person falling against the skirt 14 will slide thereon onto the rebound surface 12 without injury.

FIG. 6 is a cutaway drawing of the interior of the exercise cell 15 showing the restraining nets 20 and the game nets 22. The restraining nets 20 lie generally in mutually perpendicular vertical planes and divide the exercise cell 15 into quadrants. The restraining nets 20 which are preferably made of strong nylon breather material, serve to prevent users from injuring each other while playing or exercising. Thus, at least four persons (one for each quadrant) can exercise or play at the same time without risking injury. If desired, single or multiple nets 20, depending upon the size of exercise area desired, can be employed. The nets 20 are taut and thus deflect players as previously described in reference to skirt 14.

Above the restraining nets 20 and in generally the same planes, are two perpendicular game nets 22. Their function will be more fully described below in reference to a game played within the cell 15. The restraining nets 20 are 7 feet in height, and the game nets 22 are 18 inches high, and generally 10 feet above the rebound surface 12.

Referring now to FIG. 7, the restraining and game nets 20,22 are each attached to an opposing pair of vertical support members 28 by means of plural short ropes 62. The precise nature of the attachment is not of critical importance to the invention and could be accomplished in other ways well known to those of ordinary skill in the art, so long as the nets 20 remain relatively taut. The nets 20 and 22 are thus attached to four different vertical support means 28.

The exercise cell 15 which has been described, is not only suitable for exercise, but also for the inventive ball game which will now be described.

The ball game can be played one-against-one, i.e., singles, two-against-two, i.e., doubles, and also by three or four individuals each playing for themselves. The game will be described in terms of singles and doubles. However, obvious variations will be apparent from these descriptions.

A 14-inch diameter, light game ball, similar to a volleyball, is used. It is also possible to use a special 6-pound medicine ball for exercising and timing only. The object of the game is to hit or pass a ball back and forth over the game nets 22 without permitting it to touch the rebound surface 12. The players attempt to place the ball into the opposing court in a position which makes it difficult for the opponents to return it.

All players stand still anywhere in their quadrant to begin the game, whether it be singles or doubles. The server may stand any place in his quadrant that he chooses. He may serve with no bounce, or he may serve with one bounce, that is, he may bounce into the air from a dead stand as long as the ball leaves his hand before he again contacts the rebound surface 12. All other players may begin motion only after the ball leaves the server's hand. If the server does not clear the net 22 and the ball falls back into his court, it is called a miss, and the other side scores one point. It is permissible on service and during play for the ball to hit the skirt 14 surrounding the rebound surface 12.

A player may not at any time touch the game net 22 or any portion of the restraining net 20 below it. If he does so, his opponent gains a point. When spiking the ball at the apex of his bounce, a player's hands may not go beyond the vertical plane of the game net 22.

In singles play, each player occupies one quadrant of space. The game is preferably played parallel rather than diagonally. Of course, the game could be played by each player using one-half of the full playing area by removing one playing net 22 and restraining net 20. However, the game is best played with a limited amount of horizontal space. In singles, scoring only occurs as described above with respect to the service and when one player allows the ball to strike the rebound surface 12 or he is unable to return it within one bounce of his body against the rebound surface. If a player catches the ball while his feet are in contact with the rebound surface, he may go into the air and contact the rebound surface once. Then he must release the ball. If the rebound surface is contacted twice from an aerial position, it is considered a miss, and the opposing player gains one point.

In doubles play, the area of play consists of all four quadrants, each player occupying one quadrant. The game is played both diagonally and in parallel. With respect to serving, Server No. 1 of Team A is allowed two serves after which the ball goes to Server No. 1 of Team B. After two serves, the ball goes to Server No. 2 of Team A who serves twice and then relinquishes the ball to Server No. 2 of Team B. The cycle is then repeated until there is a winner. Either side may score whether they are server or receiver. Scoring only occurs from a miss in serving, i.e., two fouls, and when a player allows the ball to strike the rebound surface 12 or he is unable to return it within two bounces of his or his team mate's body against the rebound surface 12. Each team therefore has two bounces to return the ball. The bounces can be taken by one team member or the ball may be passed to the team mate and split between the two players. If a player catches a ball while his feet are in contact with the rebound surface, he may go into the air and he or his team mate may contact the rebound surface two more times before passing the ball. If the rebound surface is contacted three times from an aerial position, it is considered a miss and the opposing team gains a point.

Another aspect of a ball game which can be played by one or more players and is best shown in FIG. 5 involves attempting to throw a ball through a first aperture 21 in the skirt 14. If a player is successful in the toss, the ball is guided by a ramp 25 to a second aperture 23 located below the first aperture 21. The ball then passes through the second aperture 23 and is returned to the cell 15. The ramp 25 can be made from the same type of breather fabric material as is the skirt 14 and may be attached to the skirt 14 by sewing or any other convenient method which is apparent to those of ordinary skill.

FIGS. 8, 9, and 10 show an alternative embodiment of the invention. In FIG. 8, the device is shown to include a rebound surface 63 which forms the upper surface of an air-filled mattress 64. The rebound surface 63 has a rebound factor of at least 20% and preferably at least 30%. The mattress 64, including rebound surface 63, is formed of air-tight material, such as rubberized nylon fabric. The sidewalls 65 of the mattress 64 are tucked inwardly by a resilient cord or spring 66 which is placed approximately midway along the height of said sidewalls 65 and has a relaxed diameter which is smaller than the normal inflated diameter of said mattress 64. The mattress 64 is sized to provide an upper rebound surface 63 approximately the same size as surface 12 of the preferred embodiment.

The interaction of the spring 66 and mattress 64 produces lower and upper bulges 68 and 70 in the sidewalls 65. The mattress 64 is filled with air maintained under pressure by a fan 72. The precise structure and operation of such a fan is well known to those of ordinary skill in the art and is shown in U.S. Pat. No. 4,068,739, hereby incorporated by reference herein. Attached to the perimeter of the rebound surface 63 and within the outer edge of the mattress 64 is a larger enclosure 74 which is formed from a flexible air-tight fabric material and filled with air maintained under pressure by a fan 76. The pressure of the air within the enclosure 74 is less than the pressure of the air in mattress 64. The enclosure 74 thus creates a large, ballon-like cell supported vertically by the air pressure within which stretches the fabric walls taut. The cell 77 can be entered through an opening, such as through a zipper 78, which is rapidly re-closed to maintain air pressure within cell 77. Within the enclosure 74 are located the restraining and game nets 20 and 22, typically strung from the taut walls of enclosure 74. The interior of the exercise and game cell in FIG. 8 is thus quite similar to that described above for the other preferred embodiment.

Another aspect of this preferred embodiment is shown in FIG. 9. The mattress 64 contains a plurality of partitions 80 formed of netting to permit free air flow within the mattress 64. The netting partitions 80 may have many different configurations within the mattress 64. However, as shown, they extend laterally from one side of the mattress to the other and are generally radially oriented, separated by 45°. The upper and lower edges of the partitions are attached, as by sewing, to the underside of rebound surface 63 and the top of bottom surface 79, respectively, of the mattress 64. The partitions 80 are not connected to the mattress at their sides.

The function of the partitions can thus be understood with reference to FIGS. 10 and 11. The schematic of FIG. 10 shows the air mattress 64 at equilibrium. In this configuration, partitions 80 maintain the surfaces 63 and 79 mutually parallel and flat, prohibiting the air pressure within the mattress 64 from bulging these surfaces. FIG. 11 shows the mattress 64 when a portion of it has been depressed, such as by a person jumping on the rebound surface 63. The depression 81 of the rebound surface 63 has a natural tendency to bulge the sides 65 of the mattress 64 outward and also to bulge the rebound surface 63 upward. The natural upward tendency of the rebound surface 63 in reaction to the depression 81 is not desirable because it would tend to affect the user of the device, perhaps causing him to lose his balance. The partitions 80, however, which are connected internally to the top 63 and bottom 79 of the mattress 64 prevent the rebound surface from expanding upward in reaction to a depression on its surface. Thus, the reaction to a depression on the rebound surface is limited to bulging at sides 65 of the mattress 64 outward, as is shown in FIG. 11. Since this bulging is accompanied by a resilient stretching of the spring or cord 66, the mattress 64 provides a highly resilient jumping surface 63 for the user.

As with the preferred embodiment, the embodiment of FIGS. 8–11 may be used for the described net game, and protects, using the cell 77, players from injury.

I claim:

1. A structure for use as an exercise compartment comprising:

means for forming a rebound surface, said surface acting as a horizontal springboard which allows a user to exercise by jumping on said surface;

rigid support means for supporting said rebound surface; and means for enclosing the air space above said rebound surface to form a cell above said rebound surface, said cell of a sufficient size to permit one or more humans to use said rebound surface as an exercise springboard, said enclosing means positioned at or within the outer perimeter of said surface to protect the user from being injured by falling from said surface or by encountering said rigid support means while exercising.

2. The structure of claim 1 further comprising:

restraining means suspended over said rebound surface for dividing said cell into sections and for prohibiting a person bouncing against said rebound surface in one of said sections from entering an adjacent section which may be occupied by another user.

3. The structure of claim 1 further comprising:

means for holding said enclosing means taut about said cell to deflect a user falling against said enclosing means onto the rebound surface.

4. The structure of claim 2 wherein said restraining means comprises two mutually perpendicular vertical nets.

5. A structure for use as an exercise compartment comprising:

means for forming a horizontal rebound surface, said rebound surface having upper and lower sides;

rigid support means for supporting said rebound surface, said supporting means attached to the outer perimeter of said rebound surface;

means for enclosing said upper side of the rebound surface, said enclosing means being positioned within the outer perimeter of said rebound surface, thereby forming a cell above said rebound surface, said cell of a size suitable for enclosing at least one human using said rebound surface as an exercise springboard.

6. A structure for use as an exercise compartment comprising:

means for forming a rebound surface, said rebound surface having a rebound factor of at least 20%;

means for horizontally supporting said rebound surface; and means for enclosing the air space above said rebound surface to form a cell above said rebound surface, said cell of a sufficient size to permit one or more humans to use said rebound surface as an exercise springboard, said enclosing means positioned at or within the outer perimeter of said surface to protect the user from being injured by falling from said surface or by encountering said support means while exercising.

7. The structure of claim 6 wherein said rebound surface has a rebound factor of at least 30%.

8. The structure of claim 6 or 7 further comprising:

restraining means suspended over said rebound surface for dividing said cell into sections and for prohibiting a person bouncing against said rebound surface in one of said sections from entering an adjacent section which may be occupied by another user.

9. The structure of claim 6 or 7 further comprising:

means for holding said enclosing means taut about said cell to deflect a user falling against said enclosing means onto the rebound surface.

10. The structure of claim 8 wherein said restraining means comprises two mutually perpendicular vertical nets.

11. A structure for use as an exercise compartment comprising:

means for forming a rebound surface;

upper rigid support means for supporting said rebound surface above the ground;

lower support means which is located at ground level and is generally parallel to said upper rigid support means;

a plurality of vertical support means which connect said upper rigid support means and lower support means and which meet at an apex above said surface;

means for enclosing the air space above said rebound surface and within said vertical support means to form a cell above said rebound surface, said cell of a size suitable for enclosing at least one person using said rebound surface as a springboard.

* * * * *